US007606710B2

(12) United States Patent
Wang et al.

(10) Patent No.: US 7,606,710 B2
(45) Date of Patent: Oct. 20, 2009

(54) METHOD FOR TEXT-TO-PRONUNCIATION CONVERSION

(75) Inventors: Nien-Chih Wang, Hsinchu (TW); Ching-Hsieh Lee, Kaohsiung (TW)

(73) Assignee: Industrial Technology Research Institute, Hsinchu (TW)

( * ) Notice: Subject to any disclaimer, the term of this patent is extended or adjusted under 35 U.S.C. 154(b) by 560 days.

(21) Appl. No.: 11/314,777

(22) Filed: Dec. 21, 2005

(65) Prior Publication Data

US 2007/0112569 A1 May 17, 2007

(30) Foreign Application Priority Data

Nov. 14, 2005 (TW) ..... 94139899 A

(51) Int. Cl.
*G10L 13/08* (2006.01)
*G10L 13/06* (2006.01)

(52) U.S. Cl. ..... 704/260; 704/266

(58) Field of Classification Search ..... None
See application file for complete search history.

(56) References Cited

U.S. PATENT DOCUMENTS

| | | | | |
|---|---|---|---|---|
| 5,930,754 | A | 7/1999 | Karaali et al. | 704/259 |
| 6,029,132 | A | 2/2000 | Kuhn et al. | 704/260 |
| 6,076,060 | A | 6/2000 | Lin et al. | 704/260 |
| 6,230,131 | B1 | 5/2001 | Kuhn et al. | 704/266 |
| 6,347,295 | B1 | 2/2002 | Vitale et al. | 704/209 |
| 6,363,342 | B2 * | 3/2002 | Shaw et al. | 704/220 |
| 6,411,932 | B1 | 6/2002 | Molnar et al. | 704/260 |
| 2002/0026313 | A1 | 2/2002 | Hain | 704/249 |
| 2002/0046025 | A1 | 4/2002 | Hain | 704/243 |
| 2005/0197838 | A1 * | 9/2005 | Lin et al. | 704/260 |
| 2006/0031069 | A1 * | 2/2006 | Huang et al. | 704/243 |
| 2006/0265220 | A1 * | 11/2006 | Massimino | 704/235 |

FOREIGN PATENT DOCUMENTS

TW 233589 6/2005

OTHER PUBLICATIONS

Bi-directional Conversion Between Graphemes And Phonemes Using A Joint N-gram Model Lucian Galescu, James F. Allen Department of Computer Science University Of Rochester, U.S.A., 2005.
Grapheme-to-Phoneme Conversion Using Multiple Unbounded Overlapping Chunks Francois Yuon Ecole Nationale superieure des Telecommunications Computer Science Department 46, rue Barrault 75 013 Paris cmp-lg/9608006 Aug. 14, 1996.
TreeTalk: Memory-Based Word Phonemisation Walter Daelemans Antal van den Bosch R. I. Damper(Ed.) Data-Driven Techniques in Speech Synthesis. Kluwer, 149-172, 2001 ILK, Computational Linguistics, Tilburg University p. 1-27.
A Multistrategy Approach To Improving Pronunciation by Analogy Yannick Marchand Robert I. Damper 2000 Association for computational Linguistics p. 195-219.

* cited by examiner

*Primary Examiner*—Matthew J Sked

(57) ABSTRACT

A method for text-to-pronunciation conversion includes a process for searching grapheme-phoneme segments and a three-stage process of text-to-pronunciation conversion. This method looks for a sequence of grapheme-phoneme pairs, which is referred to as a chunk, via a trained pronouncing dictionary, performs grapheme segmentation, chunk marking and a decision process on an input text, and determines a pronouncing sequence for the text. With the chunk marking, the method greatly reduces the search space on the associated phoneme graph, and thereby efficiently enhances the search speed for the candidate chunk sequences. The method keeps a high word-accuracy as well as saves computing time.

12 Claims, 7 Drawing Sheets

| | N-gram model (n=3) | N-gram model (n=4) | PbA | multi-stage text-to-speech | present invention |
|---|---|---|---|---|---|
| word accuracy | 64.29% | 67.89% | 58.54% | 69.13% | 68.36% |
| phoneme accuracy | 91.20% | 91.91% | 89.04% | 92.29% | 93.15% |
| speed for PC version (word/sec) | 16.66 | 2.78 | 250.73 | 38.31 | 133.12 |
| speed for PDA version (word/sec) | | | | 0.13 | 1.12 |
| hardware required space (MB) | 1.31 | 5.43 | 5.26 | 11.48 | 5.908 |

FIG. 7

METHOD FOR TEXT-TO-PRONUNCIATION CONVERSION

FIELD OF THE INVENTION

The present invention generally relates to speech synthesis and speech recognition, and more specifically to a method for phonemisation which is applicable to the phonemisation model for mobile information appliances (IAs).

BACKGROUND OF THE INVENTION

Phonemisation is a technology that converts an input text into pronunciations. Even prior to the information appliance era, worldwide analysts had long predicted the application of the audio-based human-computer interface to reach booming highs over the information industry. The phonemisation technology has been widely used in systems related to speech synthesis as well as speech recognition.

Conventionally, the fastest way to get the pronunciation of a word is through direct dictionary lookup. The problem is no single dictionary can include all words/pronunciations. When a word lookup system cannot find a particular word, the technique of phonemisation can be employed to generate the pronunciations of the word. In speech synthesis, phonemisation provides an audio system with the pronunciations for a missing word and avoids the audio output error due to the lack of pronunciation for missing words. In speech recognition, it is a common process to expand the trained audio vocabulary set/database by adding new words/pronunciations to enhance the accuracy of the speech recognition. With phonemisation, a speech recognition system can easily process the missing pronunciation and minimize the difficulty for the audio vocabulary set/database expansion.

A conventional phonemisation is rule-based which maintains a large rule set prepared by linguistic specialists. But no matter how many rules you have, exceptions always happen. There is also no guarantee not to conflict to the existing rules by adding a new rule. With the growing of the rule-database, the cost for the rule-database refinement and maintenance is also getting high. Other than this, since rule-databases differ from language to language, it is hard to expand the same rule-database to a different language without major efforts to redesign a new rule-database. In general, a rule-based text-to-pronunciation conversion system has limited expandability due to its lacking of reusability and portability.

To overcome the aforementioned drawbacks, more and more text-to-pronunciation conversion systems gear to data-driven methods, such as pronunciation by analogy (PbA), neural-network model, decision tree model, joint N-gram model, automatic rule learning model, and multi-stage text-to-pronunciation conversions model, etc.

A data-driven text-to-pronunciation conversion system has the advantage of minimum involvement of manual labor and specialty knowledge, and is language-independent. Compared with a conventional rule-based system, a data-driven text-to-pronunciation conversion system is superior, from the perspectives of system construction, future maintenance, and reusability, etc.

Pronunciation by analogy decomposes an input text into a plurality of strings of variable lengths. Each string is then compared with the words in a dictionary to identify the most representative phoneme for each string. After that, it constructs an associate graph composed of the strings accompanied with the corresponding phonemes. The optimal path in the graph is selected to represent the pronunciation of the input text. U.S. Pat. No. 6,347,295 disclosed a computer method and apparatus for grapheme-to-phoneme conversion. This technology uses the PbA method, and requires a pronouncing dictionary. In the pronouncing dictionary, it searches for each segment that has ever occurred, as well as its occurrence count as a score to construct the whole phoneme graph.

A text-to-pronunciation conversion with neural-network model is exampled by the method disclosed in the U.S. Pat. No. 5,930,754. This prior art disclosed a technology of manufacture for neural-network based orthography-phonetics transformation. This technique requires a predetermined set of input letter feature to train a neural-network-model to generate a phonetic representation.

A text-to-pronunciation conversion technique with decision tree model is exampled by the method disclosed in the U.S. Pat. No. 6,029,132. This prior art disclosed a method for letter-to-sound in text-to-speech synthesis. This technique is a hybrid approach, using decision trees to represent the established rules. The phonetic transcription of an input text is also represented by a decision tree. Another U.S. Pat. No. 6,230,131, also disclosed a decision tree method for phonetics-to-pronunciation conversion. In this prior art, the decision tree is utilized to identify the phonemes, and probability models are followed to identify the optimum path to generate the pronunciation for the spelled-word letter sequence.

A text-to-pronunciation conversion with joint N-gram model is done by first decomposing all text/phonetic transcriptions into grapheme-phoneme pairs. A probability model is built with all grapheme-phoneme pairs from all words/phonetic transcriptions. After that, any input text is also decomposed into grapheme-phoneme pairs. The optimum path of the grapheme-phoneme pair sequence for the input text is obtained by comparing the grapheme-phoneme pairs of the input text with the pre-built grapheme-phoneme probability model to generate the final pronunciation of the input text.

Multi-stage text-to-speech conversion is an improving process, which emphasizes on graphemes (vowels) that are easily mispronounced, with more prefix/postfix information for further verification before the final pronunciation is generated. This text-to-speech conversion technique is disclosed in U.S Pat. No. 6,230,131.

The aforementioned data-driven techniques all need a training set of pronunciation information, which is usually a dictionary with sets of word/phonetic transcriptions. Amongst these techniques, PbA and joint N-gram models are the two methods referenced the most, while the multi-stage text-to-speech conversion model is the one with the best functionality.

PbA has good execution efficiency, but the accuracy is not satisfactory. The joint N-gram model although has good accuracy, the associate decision graph composed of grapheme-phoneme mapping pairs is too large when n=4, and its execution efficiency the worst amongst all methods. The multi-stage model although yields the highest resulting pronunciation, the overhead process for the further verification on easily mispronounced graphemes limits the enhancement to its overall execution efficiency.

Since audio is an important media for man-machine interface in the mobile information appliance era, and the text-to-pronunciation technique plays a critical role in speech-synthesis and speech-recognition, researching and developing superior techniques for text-to-pronunciation techniques is essentially necessary.

SUMMARY OF THE INVENTION

To overcome the aforementioned drawbacks in conventional data-driven phonemisation techniques, the present invention provides a method for text-to-pronunciation conversion, which is a data-driven and three-stage phonemisation model including a pre-process for grapheme-phoneme pair sequence (chunk) searching, and a three-stage text-to-pronunciation conversion process.

In the grapheme-phoneme chunk searching process, the present invention looks for a sequence of candidate grapheme-phoneme pairs (referred to as chunks), via a trained pronouncing dictionary. The three-stage text-to-pronunciation conversion process comprises the following: the first stage performs the grapheme segmentation (GS) to the input word and results in a grapheme sequence; the second stage performs chunk marking process according to the grapheme sequence from stage one and the trained chunks, and generates candidate chunk sequences; the third stage performs the decision process on the candidate chunk sequences from stage two. Finally, by the weight adjusting between the evaluation scores from stage two and stage three, the resulting pronunciation sequence for the input word can be efficiently determined.

The experimental result demonstrates that, with the chunk marking technique disclosed in the present invention, the search space for the associated phoneme graph is greatly reduced, and the searching speed is efficiently improved by almost three times over an equivalent conventional multi-stage text-to-speech model. Other than this, the hardware requirement for the present invention is only half of that for an equivalent conventional product and the present invention is also installable.

The foregoing and other objects, features, aspects and advantages of the present invention will become better understood from a careful reading of a detailed description provided herein below with appropriate reference to the accompanying drawings.

BRIEF DESCRIPTION OF THE DRAWINGS

FIG. 7 shows the experimental results of the present invention.

DETAILED DESCRIPTION OF THE PREFERRED EMBODIMENTS

Figure 1:
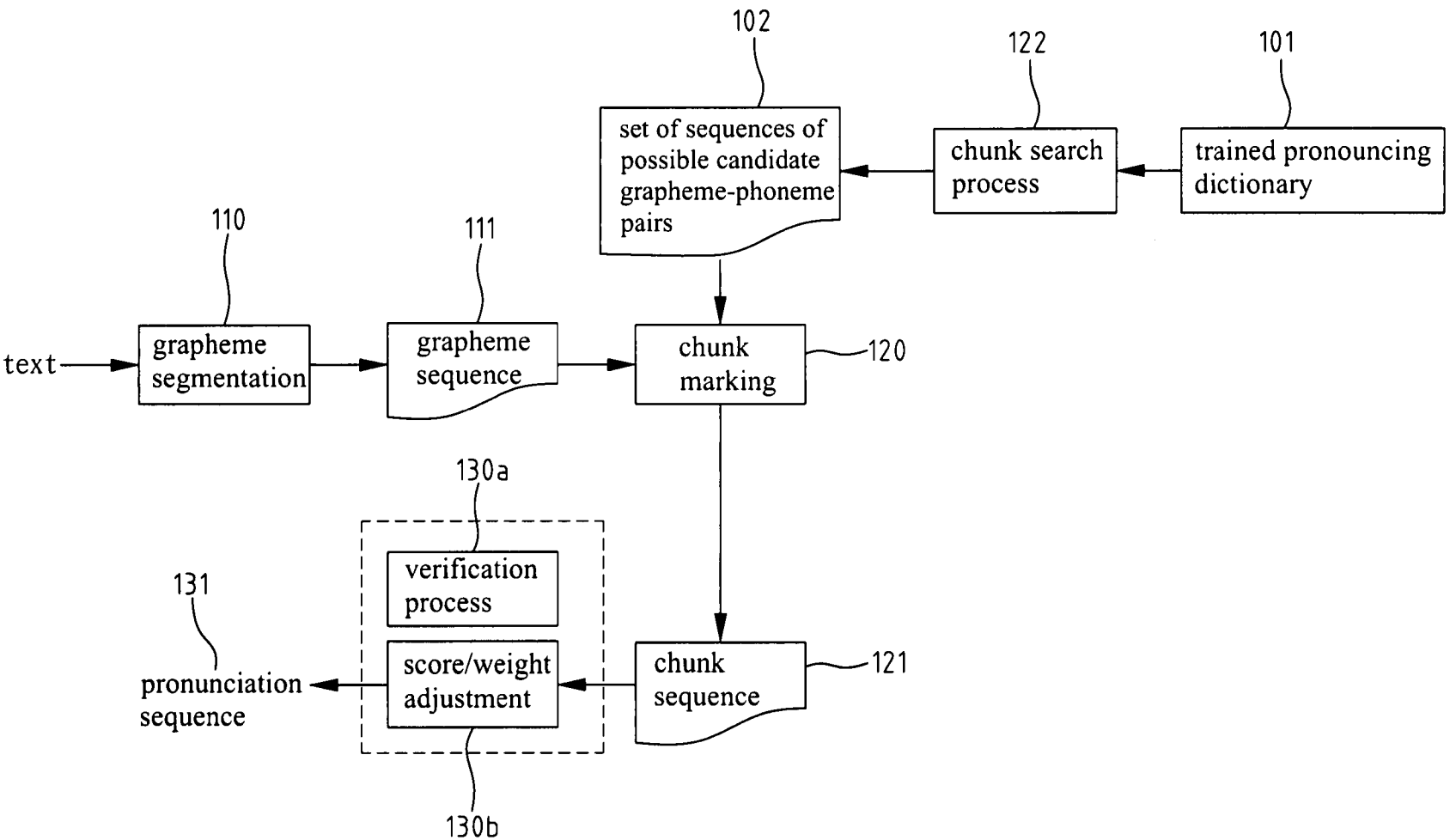
FIG. 1 is a flow chart illustrating the text-to-pronunciation conversion method according to the present invention.

FIG. 1 is a flow chart illustrating the method of text-to-pronunciation conversion according to the present invention. This method includes a grapheme-phoneme pair sequence (chunk) searching process and a three-stage text-to-pronunciation conversion process. This method looks for a set of sequences of grapheme-phoneme pairs (a sequence of grapheme-phoneme pairs is referred to as a chunk), via a trained pronouncing dictionary, and performs grapheme segmentation, chunk marking and a decision process on an input word, and determines a pronouncing sequence for an input word.

Referring to FIG. 1, in the process for grapheme-phoneme segment searching, via a trained pronouncing dictionary 101 a chunk search process 122 searches for the set of sequences of possible candidate grapheme-phoneme pairs, as labeled 102. In the three-stage text-to-pronunciation conversion method, the first stage performs the grapheme segmentation 110 on the input text, and generates a grapheme sequence 111 The second stage performs chunk marking 120 according to the grapheme sequence 111 from stage one and the trained chunk set 102, and results in candidate chunk sequences 121. The third stage (decision process) performs the verification process 130*a* on the candidate chunk sequences 121 from stage two, followed by a score/weight adjustment 130*b* and efficiently determines the final pronunciation sequence 131 for the input text.

Figure 2:
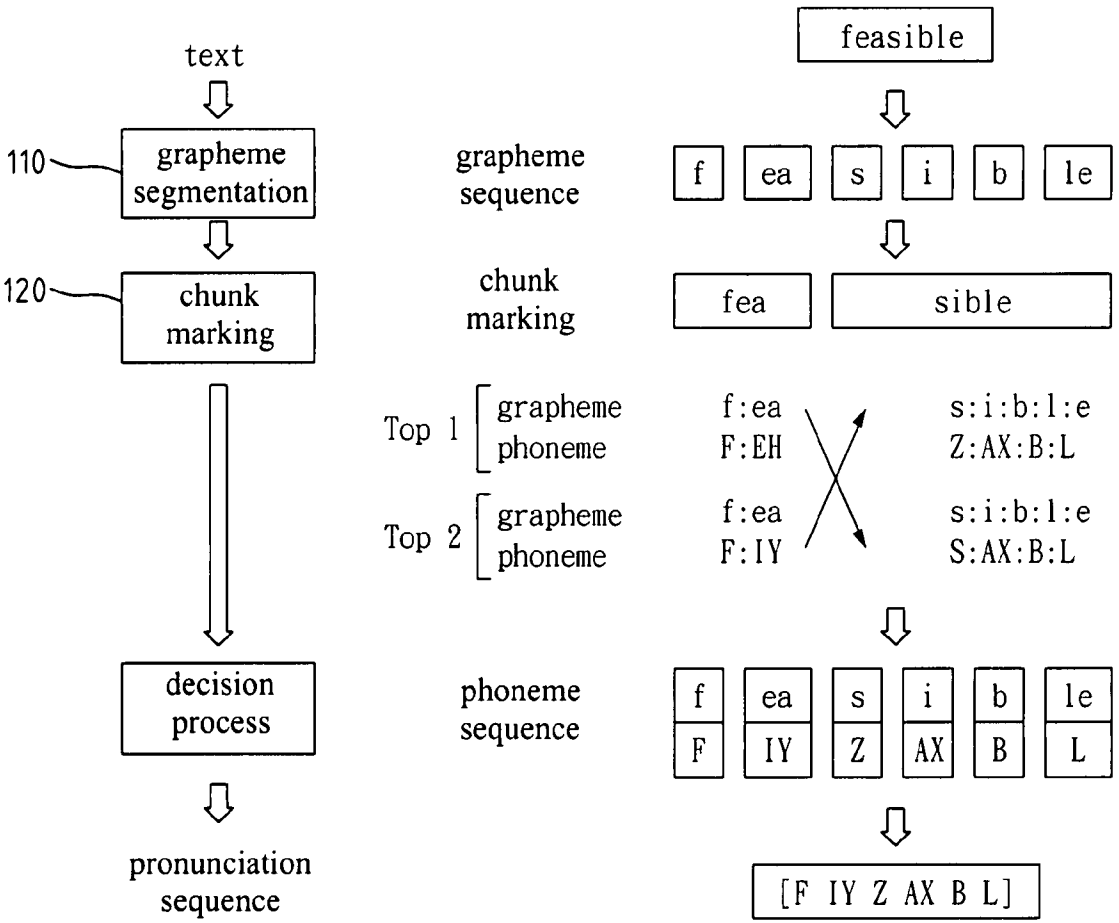
FIG. 2 demonstrates how the three-stage text-to-pronunciation conversion method shown in FIG. 1 generates the resulting pronunciation sequence [FIYZAXBL] for an input word, feasible.

FIG. 2 demonstrates how the three-stage text-to-pronunciation process shown in FIG. 1 generates the resulting pronunciation sequence [FIYZAXBL] for an input word, feasible. Referring to FIG. 2, after the grapheme segmentation process 110 to the input word feasible, the grapheme sequence (fea si b le) is generated and ends stage one. For stage two, according to this grapheme sequence (fea si b le) and the trained chunk set, the chunk marking process is done by marking the chunk fea and chunk sible and generating two candidate chunk sequences Top1 and Top2. For stage three, the verification process is done on the candidate chunk sequences Top1 and Top2, followed by an index/weight adjustment, the resulting pronunciation sequence [FIYZAXBL] for the input word feasible is efficiently determined.

Figure 3:
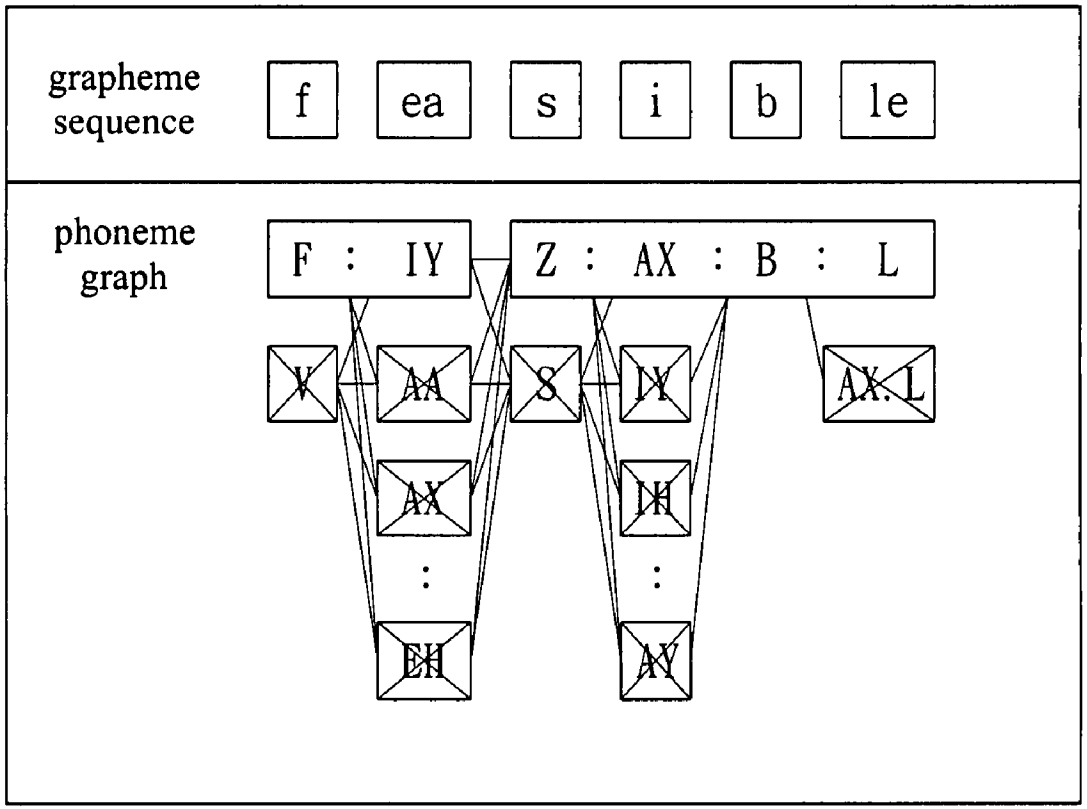
FIG. 3 illustrates how the search space on the associate phoneme graph is reduced by the chunk marking process in accordance with the present invention.

According to the example in FIG. 2, since the chunk set already contains the possible grapheme-phoneme pairs, whole space for the chunk graph from the chunk marking is much smaller than the space for the associate phoneme graph from an equivalent conventional method. FIG. 3 shows how the search space on the associate phoneme graph is reduced by the chunk marking in accordance with the present invention.

The following details the explanation for the aforementioned processes for grapheme-phoneme segment searching, grapheme segmentation, chunk marking, and verification process.

Grapheme-Phoneme Segment Searching:

In the present invention, a chunk is defined as a grapheme-phoneme pair sequence with length greater than one. A chunk candidate is defined as a chunk whose occurrence probability is greater than a certain threshold. The score of a chunk is determined by its occurrence probability value. In certain cases, however, a chunk might have different pronunciation depending on the occurrence location of the chunk. For example, when "ch" appears as a tailing, there is a 91.55% of the probability that it would pronounce as [CH]. While "ch" appears as a non-tailing, the probability that it pronounces as [CH] is only 63.91%, and there are 33.64% of chance that it pronounces as [SH]. Consequently, when a "ch" appears as a tailing of a word, its probability of pronouncing as [CH] is higher than [SH]. In the present invention, the boundary consideration (with symbol $) is added to improve the chunk searching process. In other words, adding boundary symbol or not depends on the pronunciation probability of the chunk occurring on the boundary location. Thus a grapheme-phoneme pair sequence "ch:$|CH:$" is qualified as the chunk candidate. The complete definition of a chunk is as follows:

```
Chunk = (GraphemeList, PhonemeLlist);
Length(Chunk) > 1;
P(PhonemeList\GraphemeList) > threshold;
Score(Chunk) = log (PhonemeList\GraphemeLlist).
```

Takng FIG. 2 as an example,

```
Chunk = ("s:i:b:le", "Z:AX:B:L");
Length ("s:i:b:le") = 4 > 1;
P ("s:i:b:le", "Z:AX:B:L") > threshold;
Score = log ("s:i:b:le", "Z:AX:B:L").
```

Grapheme Segmentation:

There are many alternative ways to perform grapheme segmentation (G) to an input word w. The method according to the present invention uses the N-gram model to obtain high accuracy grapheme sequence $G(w)=g_w=g_1g_2 \ldots g_n$. With the following formula:

$$S_G = \sum_{i=1}^{n} \log(P(g_i \mid g_{i-N+1}^{i-1}))$$

The experimental result shows that the accuracy rate for the resulting grapheme sequence in accordance with the present invention is as high as 90.61%, for n=3.

Figure 4:
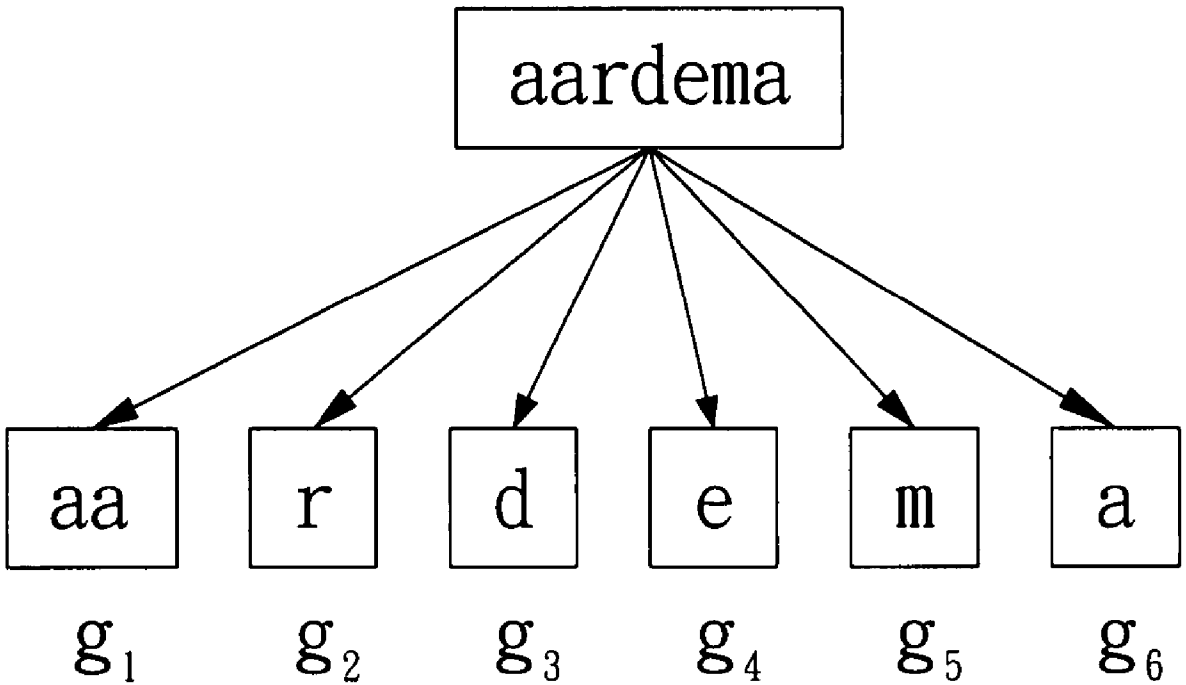
FIG. 4 demonstrates the process of grapheme segmentation using the word, aardema, as an example, and generating a grapheme sequence with an N-gram model.

FIG. 4 demonstrates the grapheme segmentation process using the word, aardema, as an example, and generates a grapheme sequence G(w) with an N-gram model, wherein, $$G(w)=aa\ r\ d\ e\ m\ a=g_1g_2 \ldots g_6.$$

Figure 5:
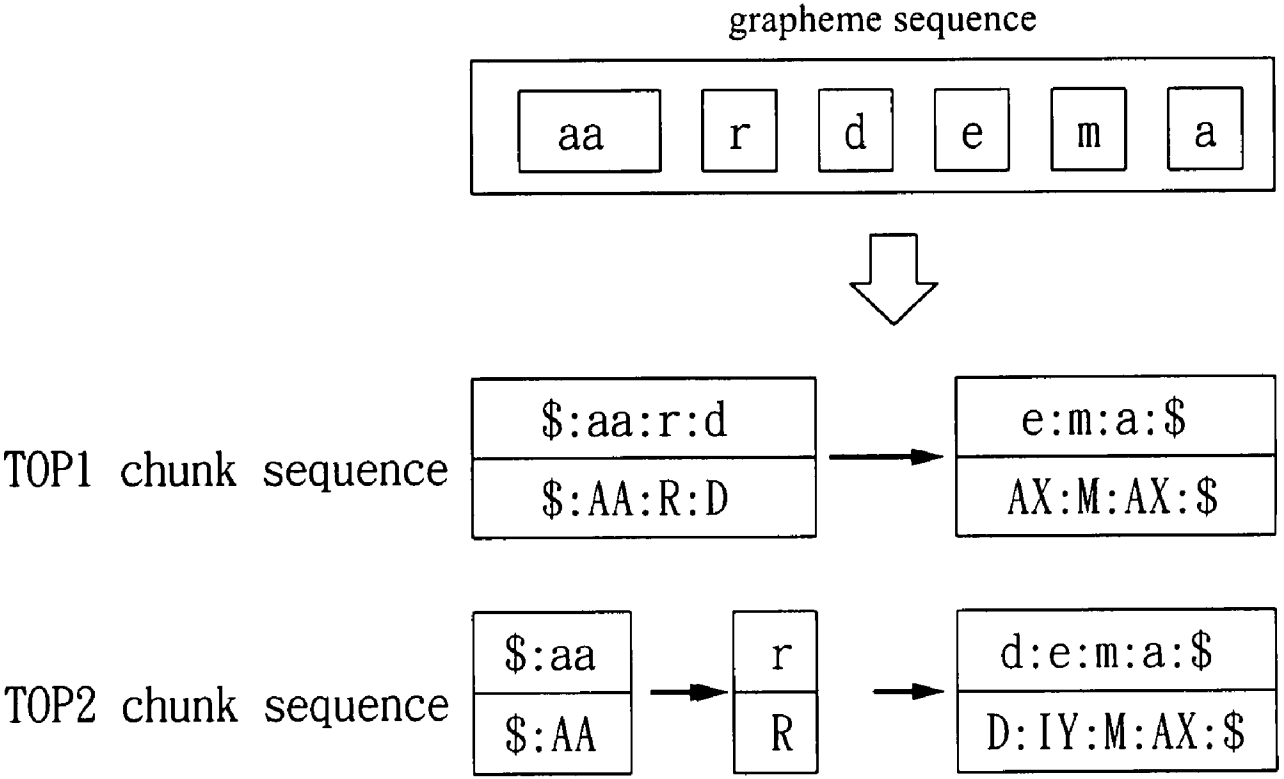
FIG. 5 illustrates the grapheme sequence generated by FIG. 4, with additional boundary information, to perform chunk marking process, and results in two candidate chunk sequences Top1 and Top2.

Chunk Marking:

As aforementioned, the search space for the associate phoneme graph is greatly reduced by the chunk marking process and the searching speed for possible candidate chunk sequences is efficiently improved. In this stage, based on the grapheme-phoneme sequences from the previous stage, chunk marking is performed and TopN chunk sequences are generated, where, N is a natural number. Referring to FIG. 5, according to the grapheme sequence from the previous stage, $g_1g_2 \ldots g_6$, with additional boundary information, this stage performs chunk marking and generates Top1 and Top2 chunk sequences, with N=2. There are various scoring formulas can be used for the chunk index, the following is one example:

$$S_c = \sum_{i=1}^{n} Chunk_i$$

Decision Process

In the decision process, the phoneme sequence decision is performed on the TopN candidate chunk sequences, followed by re-scoring on the chunk sequences. In the decision process, the re-scoring for each chunk sequence is performed based on the integrated features of intra chunks and inter chunks, and the decision score is obtained with the following formula:

$$\begin{aligned} P(f_i \mid X) &= \frac{P(X \mid f_i)P(f_i)}{P(X)} \\ &\approx \frac{P(X \mid f_i)}{P(X)} \\ &\approx \frac{P(X, f_i)}{P(X)P(f_i)} \\ &\approx \prod_{j=1}^{n} \frac{P(x_j, f_i)}{P(x_j)P(f_i)} \end{aligned}$$

In the above formula in accordance with the present invention, the decision score is obtained from the combined values from the mutual information (MI) between the characteristic group and the target phoneme $f_i$, followed by taking the log value from the above formula. The following is the formula for the decision score:

$$S_P = \sum_{i=1}^{n} \log(P(f_i \mid g_{i-R}^{i-L}))$$

Figure 6:
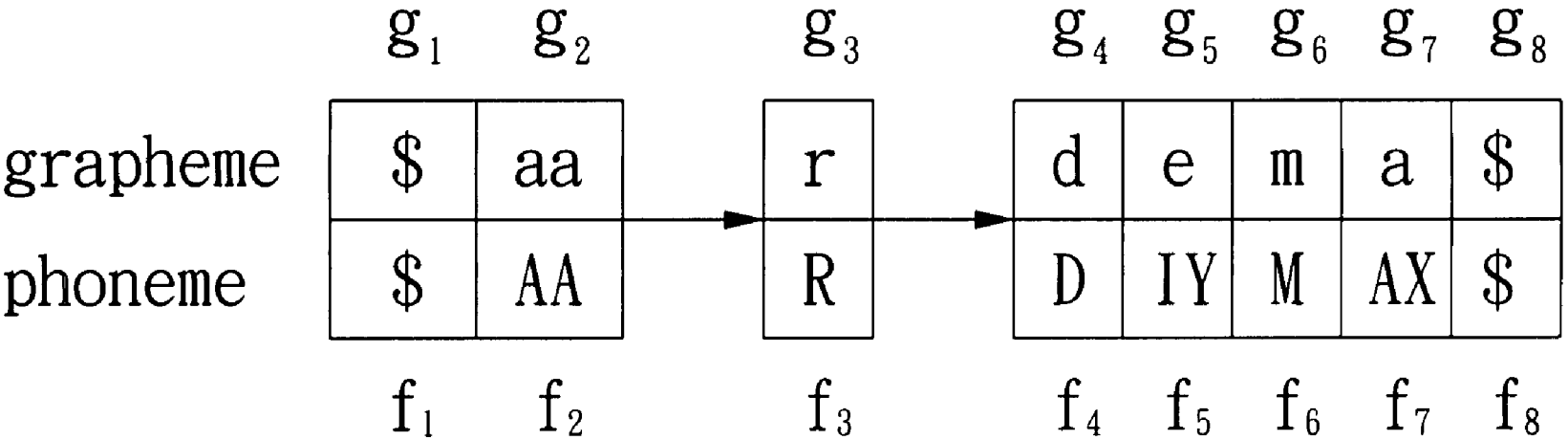
FIG. 6 illustrates the phoneme sequence verification process with the chunk sequence Top2 from FIG. 5.

FIG. 6 illustrates the phoneme sequence decision process on the Top2 chunk sequence from FIG. 5.

Finally, with the result from the previous stage of chunk marking, this final verification process selects candidate chunk sequences and the scores from TopN chunk sequences. The final scores are obtained by integrating the weight adjustment and the scoring for the decision. The resulting pronunciation is nominated by the phoneme sequence from the candidate chunk with the highest score. The formula is as follows:

$$S_{final}=S_c+W_pS_p$$

To verify the result of the present invention, the following experiment is performed. In the experiment, the pronouncing dictionary used is CMU Pronouncing Dictionary (http://www.speech.cs.cmu.edu/cgi-bin/cmudict). This is a machine-readable pronunciation dictionary, which contains over 125,000 words and their corresponding phonetic transcriptions for Northern American English. Each phonetic transcription comprises a sequence of phonemes from a finite set of 39 phonemes. The information and layout format of this dictionary is very useful for speech-syntheses and speech-recognition related areas. This pronunciation dictionary is widely used by the phonemisation related prior arts for experimental verification. The present invention also chooses this pronunciation dictionary for model verification. Excluding punctuation symbols and words with multiple pronunciations, there are 110,327 words. For each word w, the corresponding grapheme sequence $G(w)=g_1g_2 \ldots g_n$ and the phonetic transcription $P(w)=P_1P_2 \ldots P_m$ constitute a new set of grapheme-phoneme pair $GP(w)=g_1p_1g_2p_2: \ldots g_np_m$, via an automatic mapping module. Spontaneously dividing all the mapping pairs into ten groups, the experimental result is evaluated by the statistical cross-validation model.

The experimental result as shown in FIG. 7 demonstrates that, with the chunk marking technique disclosed in the present invention, the search space for the associated phoneme graph is greatly reduced. The searching speed is efficiently improved by almost three times over the equivalent conventional multi-stage text-to-speech model. Other than this, the hardware required space for the present invention is only half of that for an equivalent conventional product and is also installable. By selecting the most appropriate design parameters, the method of the present invention is applicable to a variety of audio-related products for mobile information appliances with efficient text-to-pronunciation conversion.

In conclusion, the method according the present invention is a highly efficient data-driven text-to-pronunciation conversion model. It comprises a process for searching grapheme-phoneme segments and a three-stage process of text-to-pronunciation conversion. With the proposed chunk marking, the present invention greatly reduces the search space on the associate phoneme graph, thereby efficiently enhances the search speed for the candidate chunk sequences. The method of the present invention keeps a high word-accuracy as well as saves a lot of computing time. The method of the present invention is applicable to the audio-related products for mobile information appliances.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A method for text-to-pronunciation conversion in a text-to-pronunciation conversion system, comprising:

a chunk searching process performed in said text-to-pronunciation conversion system for finding a set of possible chunks via a trained pronouncing dictionary, a chunk being defined as a sequence of grapheme-phoneme pairs;

a grapheme segmentation process performed in said text-to-pronunciation conversion system for generating a grapheme sequence from an input text;

a chunk sequence marking process performed in said text-to-pronunciation conversion system for generating candidate chunk sequences of said input text from said grapheme sequence and said set of possible chunks; and a decision process performed in said text-to-pronunciation conversion system for determining a pronouncing sequence for said input text by scoring said candidate chunk sequences of said input text;

wherein said decision process further includes a re-verifying process for a phoneme sequence by re-scoring said candidate chunk sequences according to characteristic combination of intra chunks and inter chunks.

2. The method for text-to-pronunciation conversion as claimed in claim 1, wherein a possible chunk in said chunk searching process is defined as a sequence of grapheme-phoneme pairs with length greater than one.

3. The method for text-to-pronunciation conversion as claimed in claim 1, wherein said chunk searching process adds a boundary symbol in a boundary location of a chunk in performing chunk searching.

4. The method for text-to-pronunciation conversion as claimed in claim 3, wherein adding a boundary symbol or not depends on pronunciation probability of a chunk being occurred on a boundary location.

5. The method for text-to-pronunciation conversion as claimed in claim 1, wherein said chunk searching process qualifies a chunk as a possible chunk when occurrence probability of the chunk is greater than a predetermined threshold, and the occurrence probability of the chunk is defined as a score of the chunk.

6. The method for text-to-pronunciation conversion as claimed in claim 1, wherein a scoring formula is used to evaluate a marking score for said chunk sequence marking process.

7. The method for text-to-pronunciation conversion as claimed in claim 1, wherein said decision process further performs score weight adjustment on scoring said candidate chunk sequences to determine a final pronunciation sequence for said input text.

8. The method for text-to-pronunciation conversion as claimed in claim 7, wherein a scoring formula is used to evaluate a marking score of said chunk sequence marking process.

9. The method for text-to-pronunciation conversion as claimed in claim 8, wherein a candidate chunk sequence with a highest score which accounts both said score weight adjustment and said marking score is nominated as the final pronunciation sequence for said input text.

10. The method for text-to-pronunciation conversion as claimed in claim 1, wherein said grapheme segmentation process uses an N-gram model to generate said grapheme sequence.

11. The method for text-to-pronunciation conversion as claimed in claim 1, wherein said decision process further includes a follow up evaluation with a scoring formula on scoring said candidate chunk sequences.

12. The method for text-to-pronunciation conversion as claimed in claim 1, wherein said text-to-pronunciation conversion method is applied in a text-to-pronunciation model for mobile information appliances.

* * * * *